US011224277B2

(12) United States Patent
Ganci

(10) Patent No.: US 11,224,277 B2
(45) Date of Patent: Jan. 18, 2022

(54) TWO-SIDED APPLICATOR ASSEMBLY

(71) Applicant: Mimma Ganci, Massapequa Park, NY (US)

(72) Inventor: Mimma Ganci, Massapequa Park, NY (US)

( * ) Notice: Subject to any disclaimer, the term of this patent is extended or adjusted under 35 U.S.C. 154(b) by 416 days.

(21) Appl. No.: 16/208,802

(22) Filed: Dec. 4, 2018

(65) Prior Publication Data

US 2020/0170378 A1 Jun. 4, 2020

(51) Int. Cl.
*A45D 40/24* (2006.01)
*A45D 40/04* (2006.01)

(52) U.S. Cl.
CPC ..... *A45D 40/24* (2013.01); *A45D 40/04* (2013.01)

(58) Field of Classification Search
CPC ..... A45D 2040/0018; A45D 34/06; A45D 40/24; A45D 40/265; A45D 40/04; A45D 40/18
See application file for complete search history.

(56) References Cited

U.S. PATENT DOCUMENTS 2,573,828 A * 11/1951 Braselton ..... A45D 40/04 401/31
6,745,781 B2 * 6/2004 Gueret ..... A45D 40/26 132/320
7,153,053 B1 * 12/2006 Wiley ..... A45D 34/041 401/219
8,016,801 B2 * 9/2011 Clarke ..... A46B 7/023 604/310
8,444,334 B2 5/2013 Cardia
8,556,527 B1 * 10/2013 Chou ..... A45D 40/04 401/98
9,185,963 B2 11/2015 Weeston
D745,742 S 12/2015 Betts
9,332,818 B2 5/2016 Holloway
9,693,607 B2 7/2017 Imbriani
10,039,366 B1 * 8/2018 Facer ..... A45D 40/24
2016/0143417 A1 5/2016 Eberlein
2017/0095054 A1 4/2017 Facer
2017/0215553 A1 8/2017 Keller

FOREIGN PATENT DOCUMENTS

WO WO2015027207 2/2015

* cited by examiner

*Primary Examiner* — Cris L. Rodriguez
*Assistant Examiner* — Brianne E Kalach

(57) ABSTRACT

A two-sided applicator assembly includes a first tube and a second tube. A first dispenser is rotatably coupled to the first tube and a second dispenser is rotatably coupled to the second tube. Moreover, the first dispenser is coupled to the second dispenser such that the first tube is directed in an opposite direction from the second tube. A first cylinder is movably coupled to the first dispenser and the first cylinder is comprised of a pliable material. The first cylinder is infused with a chemical lip balm for applying the chemical lip balm to lips. A second cylinder is movably coupled to the second dispenser and the second cylinder is comprised of a pliable material. The second cylinder is infused with a chemical sunscreen for applying the chemical sunscreen to skin.

7 Claims, 3 Drawing Sheets

TWO-SIDED APPLICATOR ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to applicator devices and more particularly pertains to a new applicator device carrying a stick of lip balm and a stick of sunscreen.

BRIEF SUMMARY OF THE INVENTION

An embodiment of the disclosure meets the needs presented above by generally comprising a first tube and a second tube. A first dispenser is rotatably coupled to the first tube and a second dispenser is rotatably coupled to the second tube. Moreover, the first dispenser is coupled to the second dispenser such that the first tube is directed in an opposite direction from the second tube. A first cylinder is movably coupled to the first dispenser and the first cylinder is comprised of a pliable material. The first cylinder is infused with a chemical lip balm for applying the chemical lip balm to lips. A second cylinder is movably coupled to the second dispenser and the second cylinder is comprised of a pliable material. The second cylinder is infused with a chemical sunscreen for applying the chemical sunscreen to skin.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
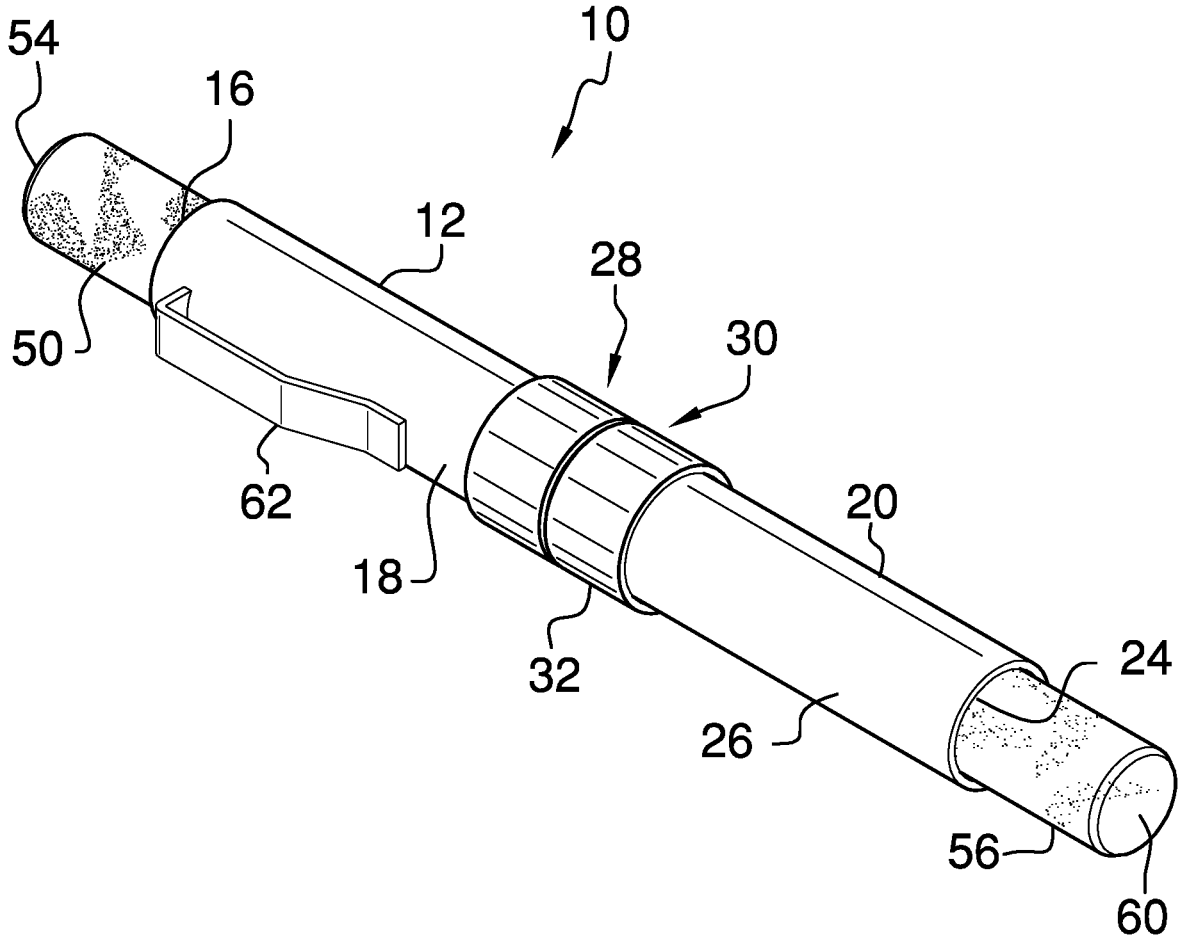
FIG. 1 is a perspective view of a two-sided applicator assembly according to an embodiment of the disclosure.
Figure 2:
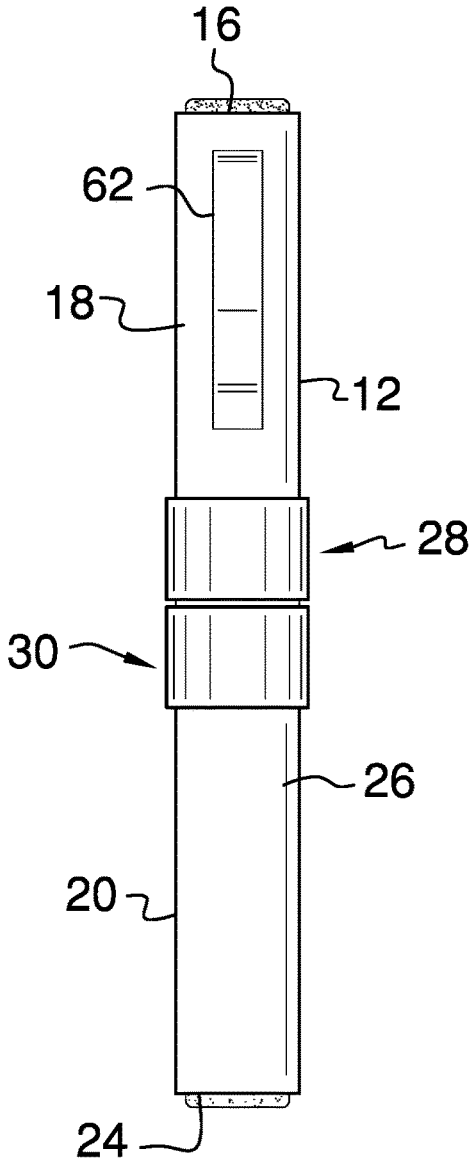
FIG. 2 is a top view of an embodiment of the disclosure.
Figure 3:
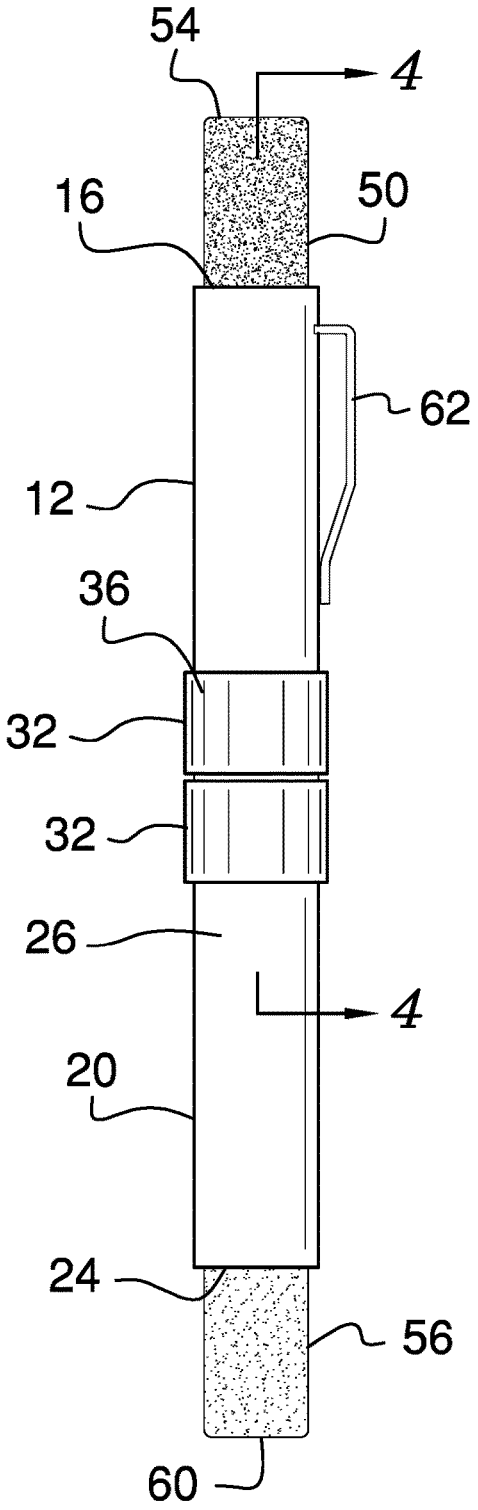
FIG. 3 is a right side view of an embodiment of the disclosure.
Figure 4:
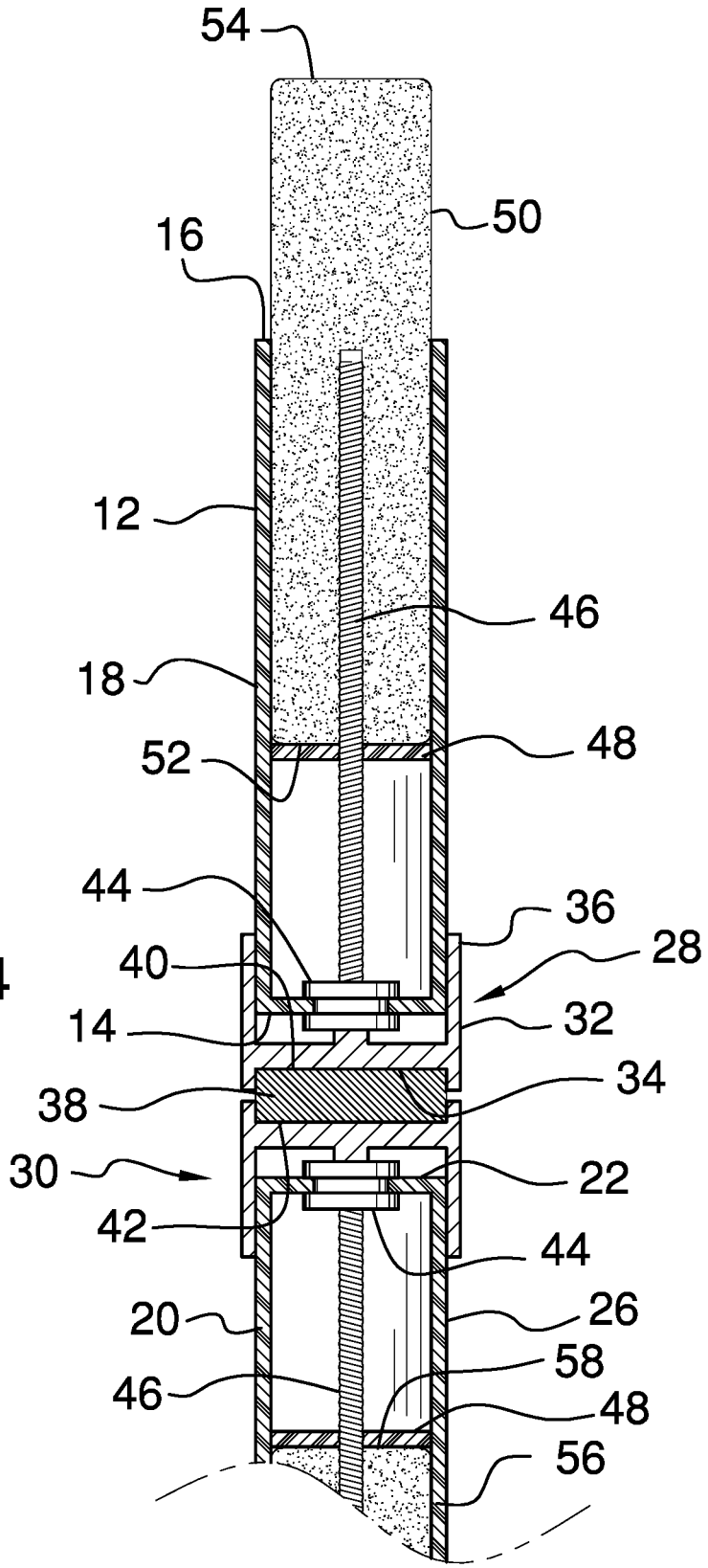
FIG. 4 is a cross sectional view taken along line 4-4 of FIG. 3 of an embodiment of the disclosure.

With reference now to the drawings, and in particular to FIGS. 1 through 4 thereof, a new applicator device embodying the principles and concepts of an embodiment of the disclosure and generally designated by the reference numeral 10 will be described.

As best illustrated in FIGS. 1 through 4, the two-sided applicator assembly 10 generally comprises a first tube 12 that has a first end 14, a second end 16 and an outer wall 18 extending therebetween, and the first end 14 is closed. A second tube 20 is included that has a primary end 22, a secondary end 24 and an exterior wall 26 extending therebetween, and the primary end 22 is closed. A first dispenser 28 is rotatably coupled to the first tube 12 and the first dispenser 28 is rotatable in a first direction or a second direction. A second dispenser 30 is rotatably coupled to the second tube 20 and the second dispenser 30 is rotatable in a first direction or a second direction. Moreover, the first dispenser 28 is coupled to the second dispenser 30 having the first tube 12 being directed in an opposite direction from the second tube 20.

Each of the first 28 and second 30 dispensers comprises a cup 32 that has a basal wall 34 and a perimeter wall 36 extending away therefrom. The basal wall 34 of the cup 32 of the first dispenser 28 is aligned with the basal wall 34 of the cup 32 of the second dispenser 30. The cup 32 of the first dispenser 28 insertably receives the first end 14 of the first tube 12 and the cup 32 of the second dispenser 30 insertably receives the primary end 22 of the second tube 20. Thus, each of the first 12 and second 20 tubes are oriented to extend in opposite directions along a lateral axis. Additionally, the cup 32 is rotatable in a first direction or a second direction.

A retainer 38 is included that has a first surface 40 and a second surface 42. The basal wall 34 of the cup 32 of the first dispenser 28 is rotatably coupled to the first surface 40. Additionally, the basal wall 34 of the cup 32 of the second dispenser 30 is rotatably coupled to the second surface 42. In this way the first tube 12 and the second tube 20 are coupled together.

Each of the first 28 and second 30 dispensers includes a bearing 44. The bearing 44 of the first dispenser 28 is rotatably positioned within the first end 14 of the first tube 12. The bearing 44 of the second dispenser 30 is rotatably positioned within the primary end 22 of the second tube 20. The basal wall 34 of the cup 32 of the first dispenser 28 is coupled to the bearing 44 of the first dispenser 28. Additionally, the perimeter wall 36 of the cup 32 of the first dispenser 28 extends around the outer wall 18 of the first tube 12. The basal wall 34 of the cup 32 of the second dispenser 30 is coupled to the bearing 44 of the second dispenser 30. The perimeter wall 36 of the cup 32 of the second dispenser 30 extends around the exterior wall 26 of the second tube 20.

Each of the first 28 and second 30 dispensers includes a screw 46 that is coupled to and extends away from the bearing 44. The screw 46 of the first dispenser 28 is positioned within the first tube 12 and extends toward the second end 16 of the first tube 12. Additionally, the screw 46 of the second dispenser 30 is positioned within the second tube 20 and extends toward the secondary end 24 of the second tube 20. Each of the first 28 and second 30 dispensers includes a disk 48 having the screw 46 extending therethrough such that the screw 46 threadably engage the disk 48. The disk 48 travels away from the bearing 44 when the cup 32 is rotated in the first direction and the disk 48 travels toward the bearing 44 when the cup 32 is rotated in the second direction.

A first cylinder 50 is movably coupled to the first dispenser 28 and the first cylinder 50 is comprised of a pliable material, such as carnauba wax or the like. The first cylinder 50 is infused with a chemical lip balm thereby facilitating the first cylinder 50 to apply the chemical lip balm to lips. The first cylinder 50 is extended outwardly from the first tube 12 when the first dispenser 28 is rotated in the first direction and the first cylinder 50 is retracted into the first tube 12 when the first dispenser 28 is rotated in the second direction. The first cylinder 50 has a first end 52 and a second end 54, and the screw 46 of the first dispenser 28 extends through the first end 52 of the first cylinder 50. The disk 48 of the first dispenser 28 abuts the first end 52 of the first cylinder 50. The disk 48 urges the second end 54 of the first cylinder 50 outwardly from the second end 16 of the first tube 12 when the cup 32 of the first dispenser 28 is rotated in the first direction.

A second cylinder 56 is movably coupled to the second dispenser 30 and the second cylinder 56 is comprised of a pliable material such as carnauba wax or the like. The second cylinder 56 is infused with a chemical sunscreen thereby facilitating the second cylinder 56 to apply the chemical sunscreen to skin. The second cylinder 56 is extended outwardly from the second tube 20 when the second dispenser 30 is rotated in the first direction and the second cylinder 56 is retracted into the second tube 20 when the second dispenser 30 is rotated in the second direction. The second cylinder 56 has a first end 58 and a second end 60, and the screw 46 of the second dispenser 30 extends through the first end 58 of the second cylinder 56. The disk 48 of the second dispenser 30 abuts the first end 14 of the second cylinder 56. The disk 48 urging the second end 16 of the second cylinder 56 outwardly from the secondary end 24 of the second tube 20 when the cup 32 of the second dispenser 30 is rotated in the first direction.

A clip 62 is coupled to the outer wall 18 of the first tube 12 and the clip 62 extends from the second end 16 of the first tube 12 toward the first end 14 of the first tube 12. The clip 62 is biased to abut the outer wall 18 of the first tube 12 and the clip 62 can releasably engage an article of clothing or the like. Thus, the first 12 and second 20 tubes can be carried on a user's clothing.

In use, the first cup 32 is rotated in the first direction to urge the first cylinder 50 outwardly from the first tube 12. In this way the chemical lip balm can be applied to a user's lip to relieve symptoms of chapped or dry lips. The first cup 32 is rotated in the second direction to retract the first cylinder 50 into the first tube 12. The second cup 32 is rotated in the first direction to urge the second cylinder 56 outwardly from the second tube 20. In this way the chemical sunscreen can be applied the user's skin for protecting against sunburn. The first 12 and second 20 tubes facilitate the chemical lip balm and the chemical sun screen to be simultaneously available to the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A two-sided applicator assembly being configured to apply either lip-balm to lips or sunscreen to skin, said assembly comprising:

a first tube, said first tube having a first end, a second end and an outer wall extending therebetween, said first end being closed;

a second tube, said second tube having a primary end, a secondary end and an exterior wall extending therebetween, said primary end being closed;

a first dispenser being rotatably coupled to said first tube, said first dispenser being rotatable in a first direction or a second direction;

a second dispenser being rotatably coupled to said second tube, said second dispenser being rotatable in a first direction or a second direction; said first dispenser being coupled to said second dispenser having said first tube being directed in an opposite direction from said second tube;

a first cylinder being movably coupled to said first dispenser, said first cylinder being comprised of a pliable material, said first cylinder being infused with a chemical lip balm wherein said first cylinder is configured to apply the chemical lip balm to lips, said first cylinder being extended outwardly from said first tube when said first dispenser is rotated in said first direction;

a second cylinder being movably coupled to said second dispenser, said second cylinder being comprised of a pliable material, said second cylinder being infused with a chemical sunscreen wherein said second cylinder is configured to apply the chemical sunscreen to skin, said second cylinder being extended outwardly from said second tube when said second dispenser is rotated in said first direction;

each of said first and second dispenser comprises a cup having a basal wall and a perimeter wall extending away therefrom, said basal wall of said cup of said first dispenser being aligned with said basal wall of said cup of said second dispenser, said cup of said first dispenser insertably receiving said first end of said first tube, said cup of said second dispenser insertably receiving said primary end of said second tube, wherein each of said first and second tubes are oriented to extend in opposite directions along a lateral axis, said cup of said first dispenser being rotatable in a first direction or a second direction relative to said first cylinder, said cup of said second dispenser being rotatable in a first direction and a second direction relative to said second cylinder; and a retainer having a first surface and a second surface, said basal wall of said cup of said first dispenser being rotatably coupled to said first surface, said basal wall of said cup of said second dispenser being rotatably coupled to said second surface wherein said first first cup is rotatable independently from rotation of said second cup.

2. The assembly according to claim 1, wherein each of said first and second dispensers comprises a bearing, said bearing of said first dispenser being rotatably positioned within said first end of said first tube, said bearing of said second dispenser being rotatably positioned within said primary end of said second tube, said basal wall of said cup of said first dispenser being coupled to said bearing of said first dispenser having said perimeter wall of said cup of said first dispenser extending around said outer wall of said first tube, said basal wall of said cup of said second dispenser being coupled to said bearing of said second dispenser having said perimeter wall of said cup of said second dispenser extending around said exterior wall of said second tube.

3. The assembly according to claim 2, further comprising a screw being coupled to and extending away from said bearing, said screw of said first dispenser being positioned within said first tube and extending toward said second end of said first tube, said screw of said second dispenser being positioned within said second tube and extending toward said secondary end of said second tube.

4. The assembly according to claim 3, further comprising a disk having said screw extending therethrough having said screw threadably engaging said disk, said disk traveling away from said bearing when said cup is rotated in said first direction, said disk travelling toward said bearing when said cup is rotated in said second direction.

5. The assembly according to claim 4, wherein said first cylinder is retracted into said first tube when said first dispenser is rotated in said second direction, said first cylinder having a first end and a second end, said screw of said first dispenser extending through said first end of said first cylinder, said disk of said first dispenser abutting said first end of said first cylinder, said disk urging said second end of said first cylinder outwardly from said second end of said first tube when said cup of said first dispenser is rotated in said first direction.

6. The assembly according to claim 5, wherein said second cylinder is retracted into said second tube when said second dispenser is rotated in said second direction, said second cylinder having a first end and a second end, said screw of said second dispenser extending through said first end of said second cylinder, said disk of said second dispenser abutting said first end of said second cylinder, said disk urging said second end of said second cylinder outwardly from said secondary end of said second tube when said cup of said second dispenser is rotated in said first direction.

7. A two-sided applicator assembly being configured to apply either lip-balm to lips or sunscreen to skin, said assembly comprising:

a first tube having a first end, a second end and an outer wall extending therebetween, said first end being closed;

a second tube having a primary end, a secondary end and an exterior wall extending therebetween, said primary end being closed;

a first dispenser being rotatably coupled to said first tube, said first dispenser being rotatable in a first direction or a second direction;

a second dispenser being rotatably coupled to said second tube, said second dispenser being rotatable in a first direction or a second direction; said first dispenser being coupled to said second dispenser having said first tube being directed in an opposite direction from said second tube, each of said first and second dispenser comprising:

a cup having a basal wall and a perimeter wall extending away therefrom, said basal wall of said cup of said first dispenser being aligned with said basal wall of said cup of said second dispenser, said cup of said first dispenser insertably receiving said first end of said first tube, said cup of said second dispenser insertably receiving said primary end of said second tube, wherein each of said first and second tubes are oriented to extend in opposite directions along a lateral axis, said cup of said first dispenser being rotatable in a first direction or a second direction relative to said first cylinder, said cup of said second dispenser being rotatable in a first direction and a second direction relative to said second cylinder;

a retainer having a first surface and a second surface, said basal wall of said cup of said first dispenser being rotatably coupled to said first surface, said basal wall of said cup of said second dispenser being rotatably coupled to said second surface wherein said first first cup is rotatable independently from rotation of said second cup;

a bearing, said bearing of said first dispenser being rotatably positioned within said first end of said first tube, said bearing of said second dispenser being rotatably positioned within said primary end of said second tube, said basal wall of said cup of said first dispenser being coupled to said bearing of said first dispenser having said perimeter wall of said cup of said first dispenser extending around said outer wall of said first tube, said basal wall of said cup of said second dispenser being coupled to said bearing of said second dispenser having said perimeter wall of said cup of said second dispenser extending around said exterior wall of said second tube;

a screw being coupled to and extending away from said bearing, said screw of said first dispenser being positioned within said first tube and extending toward said second end of said first tube, said screw of said second dispenser being positioned within said second tube and extending toward said secondary end of said second tube; and a disk having said screw extending therethrough having said screw threadably engaging said disk, said disk traveling away from said bearing when said cup is rotated in said first direction, said disk travelling toward said bearing when said cup is rotated in said second direction;

a first cylinder being movably coupled to said first dispenser, said first cylinder being comprised of a pliable material, said first cylinder being infused with a chemical lip balm wherein said first cylinder is configured to apply the chemical lip balm to lips, said first cylinder being extended outwardly from said first tube when said first dispenser is rotated in said first direction, said first cylinder being retracted into said first tube when said first dispenser is rotated in said second direction, said first cylinder having a first end and a second end, said screw of said first dispenser extending through said first end of said first cylinder, said disk of said first dispenser abutting said first end of said first cylinder, said disk urging said second end of said first cylinder outwardly from said second end of said first tube when said cup of said first dispenser is rotated in said first direction; and a second cylinder being movably coupled to said second dispenser, said second cylinder being comprised of a pliable material, said second cylinder being infused with a chemical sunscreen wherein said second cylinder is configured to apply the chemical sunscreen to skin, said second cylinder being extended outwardly from said second tube when said second dispenser is rotated in said first direction, said second cylinder being retracted into said second tube when said second dispenser is rotated in said second direction, said second cylinder having a first end and a second end, said screw of said second dispenser extending through said first end of said second cylinder, said disk of said second dispenser abutting said first end of said second cylinder, said disk urging said second end of said second cylinder outwardly from said secondary end of said second tube when said cup of said second dispenser is rotated in said first direction.

* * * * *